United States Patent [19]

Proellochs et al.

[11] 4,444,513

[45] Apr. 24, 1984

[54] DUAL DISPLAY WATCH

[75] Inventors: Claude-Daniel Proellochs, Neuchatel; Luigi Vignando, Meyrin-Geneve; Claude Mouche, Bienne, all of Switzerland

[73] Assignee: Eterna S.A., Grenchen, Switzerland

[21] Appl. No.: 303,911

[22] Filed: Sep. 21, 1981

[30] Foreign Application Priority Data

Oct. 27, 1980 [CH] Switzerland ..... 7971/80

[51] Int. Cl.[3] ..... G04B 19/00; G04B 25/00

[52] U.S. Cl. ..... 368/223; 368/88; 368/276; 368/283

[58] Field of Search ..... 368/88, 276, 277, 223, 368/275, 278–283, 239, 242

[56] References Cited

U.S. PATENT DOCUMENTS 2,169,099 8/1939 Ketterson ..... 368/223
3,293,846 12/1966 Pauli ..... 368/10
4,210,039 10/1978 Fischer ..... 368/10
4,236,239 11/1980 Imgruth et al. ..... 368/88

FOREIGN PATENT DOCUMENTS 55-18990 2/1980 Japan .
585929 3/1977 Switzerland .

*Primary Examiner*—Bernard Roskoski
*Attorney, Agent, or Firm*—Peter L. Berger

[57] ABSTRACT

A watch comprising at least one electronic movement, and a first and a second display means 2, 3, mounted in a case 1. The case 1 is made in two parts 4, 5 each of which bears a display means 2, 3 and is articulated in such a way as to be able selectively to occupy a first position in which the display means are superimposed, with the first hiding the second, and a second position, in which the first display means becomes visible to the wearer.

16 Claims, 8 Drawing Figures

DUAL DISPLAY WATCH

BACKGROUND OF THE INVENTION

This invention relates essentially to watches with electronic movements and, more particularly, to watches of this type which comprise dual display means.

Display means in watches are generally classified as analog and digital.

Analog displays, or in other words, those in which the hourly information is shown by means of hands moving in front of a dial and driven by an electric motor through a transmission mechanism, offer the advantages of great ease of reading and better aesthetic properties. However, with this type of display it is not possible to show the complex functions performed more and more by modern watches.

Digital displays, which reflect hourly information in the form of digits, offer considerable flexibility of use, making it possible, for example, to display a large number of functions (such as, for example, hour, minute, second, day, month, a number of time zones, chronograph, countdown, alarm, etc.). Unfortunately, rapid reading of such displays is difficult due to practical reasons relating to imperfections in the cells used up to the present time (contrast, directivity) as well as the need to read a group of digits rather than viewing the simple position of watch hands. Further, such displays are only available recently, and the use of these displays in very elegant watches causes aesthetic problems.

It is for this reason that numerous attempts have been made to reconcile the advantages of the two types of displays, notably by integrating two different displays within the same watch.

The most common solution consists in providing one of each type of display means on the same watch face. Thus, there are analog-digital watches in which a window through which a liquid crystal (LC) cell can be seen is provided in the dial of an analog display. Additionally, there are digital-analog watches in which a small-sized-analog display is juxtaposed with a digital display system. Although it is possible, with this solution, to combine the practical advantages of both types of display, such a solution in no way solves the aesthetic problems, but introduces an additional power problem, due to the fact that it is practically necessary at all times to feed the two displays that appear simultaneously to the wearer.

According to another solution, described, for example, in Japanese patent application No. 53-929271 published under No. 5518990 for Suwa Seikosha, K.K., a watch has a display on each face, one being digital and the other analog. The watch can be worn in such a way that either one or the other face appears to the wearer. A solution which is of the same type, although it pertains to two analog displays, is described in Swiss Pat. No. 408 794, which shows a timepiece comprising a watch band with two usable surfaces supporting two watches that are not superimposed. The watches are turned with respect to the watch band in such a way that, depending whether one or the other face of the band is in contact with the wrist, the dial of the other watch is visible. In this case, the aesthetics of the watch can be preserved as long as it is the analog display of the watch that is presented for view. But switching from one display to the other is not convenient nor instantaneous, as is desirable, when the wearer simply wishes to check the date on the digital display, for example. Furthermore, this type of design requires a special type of watch band. Additionally, a watch case structure comprising a display on each face is not satisfactory because of structural limitations or ease of access to the members forming the movement.

SUMMARY OF THE INVENTION

Consequently, an object of this invention is to provide a watch that comprises at least one movement, and a first and a second separate means of displaying time data mounted in a case to provide the wearer access to the advantages of each display with minimum inconvenience.

This object, as well as others which will become clear in the description which follows, is achieved by providing a case formed of two parts. Each display means is mounted in a separate part of the case, the said parts, furthermore, being articulated with respect to each other such that they can occupy, selectively, a first position in which the two display means are superimposed, with the one hiding the other, and a second position in which one display means appears to the wearer.

Thus, if a digital display is used as a first display means and an analog display as a second display means, the watch, as worn most of the time, from its appearance, would be a classic analog watch.

If the user wishes to use the digital display (for example, in order to ascertain the month, the date, or the time of day in a second time zone), he can easily retrieve this information.

Other advantages from the invention are provided when means are provided that cuts off the power supply to the first display means when it is hidden by the second, which results in an appreciable reduction in the power consumption of the watch. According to another embodiment, each display means can be controlled by its own movement, which will improve the reliability of the watch and enable the wearer to have one display correct despite a failure of the other one or of a battery. When the two parts of the case are separable, one of the display means can be used in another manner; for example, as a pendant.

BRIEF DESCRIPTION OF THE DRAWING

This invention will be clearly understood from reading the description which follows, which is given in connection with the attached drawings.

DETAILED DESCRIPTION

Figure 1A:
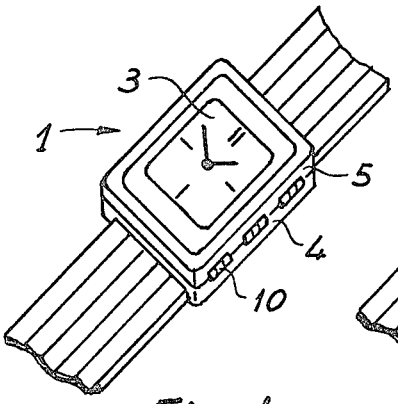
FIGS. 1*a* and 1*b* illustrate a watch in accordance with a first embodiment of the invention.
Figure 1B:
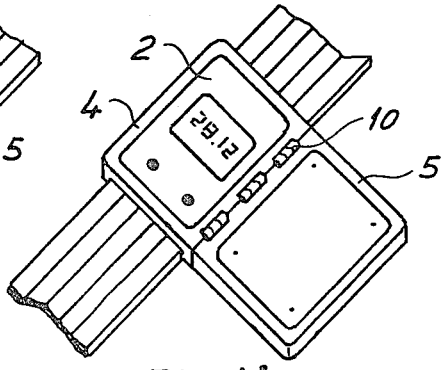
Figure 2A:
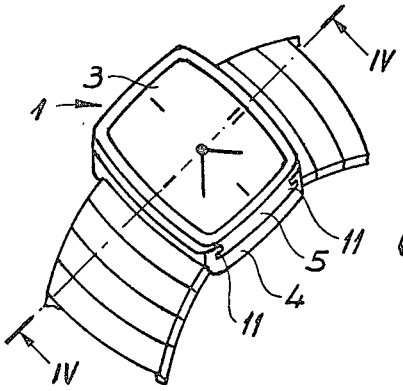
FIGS. 2*a* and 2*b*, and 3*a* and 3*b*, respectively, illustrate, in a manner similar to FIGS. 1*a* and 1*b*, respectively second and third embodiments of a watch in accordance with the invention.
Figure 2B:
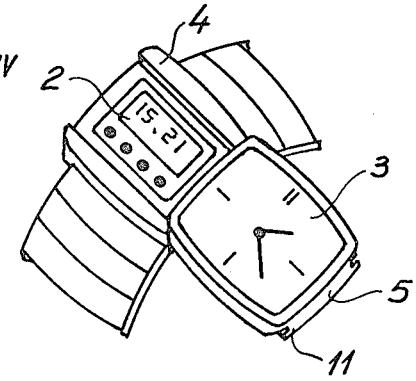
Figure 3A:
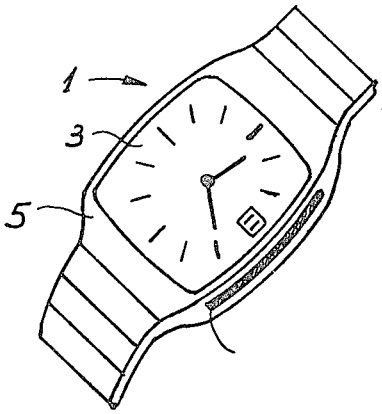
Figure 3B:
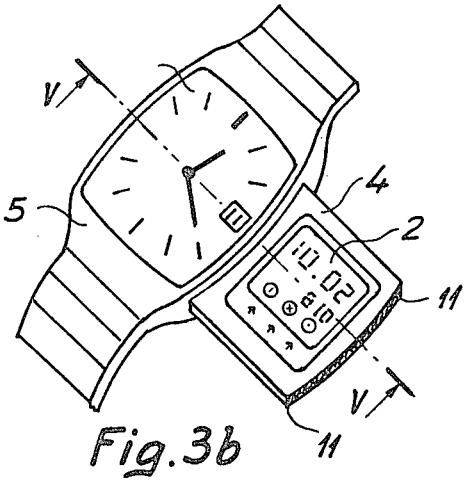

As can be seen in FIGS. 1 to 3, a watch in accordance with the invention comprises a case 1, which includes at least a movement (not shown), a first display means 2 and a second display means 3. The case 1 is made up of two parts 4 and 5 in each of which there is mounted the display means 2 and 3, respectively. The parts 4 and 5 of the case are articulated with respect to one another in such a way as to be positioned such the display means 2 and 3 are superimposed over one another, with the second 3 hiding the first 2. (FIGS. 1*a*, 2*a*, 3*a*). The parts 4 and 5 may also be positioned so that the first display means 2 appears to the wearer. (FIGS. 1*b*, 2*b* and 3*b*). The parts 4 and 5 of the case 1 can be rotatably mounted at their edges on one another by means of a hinge 10 (FIG. 1*a*) or slideably by means of guides 11 (FIGS. 2*a* and 3*a*). In the latter case, the two display means 2 and 3 always appear simultaneously to the wearer in the second position. This could also be accomplished for FIG. 1*b* when the second display means is located on the surface of the part 5 of the case which faces the first display means 2.

Preferably, the digital device is used as the first display means 2, so that the second analog display means normally appears to the wearer.

While it is more economical to use only a single movement in order to drive both display means, it is also possible to use two separate thin movements, each mounted in a separate part 4 and 5 of the case. For example, part 4 in FIG. 2 can house an extra-flat digital-display movement, while a thin analog-display movement is carried in part 5.

However, when both display devices are driven by a single movement, it will be necessary to provide a connecting device for electrically linking the movement mounted in one of the articulated parts of the case with the display means mounted in the other. Such devices are known, for example, for connecting to a calculator watch case a part articulated on the case and bearing a keyboard, as can be seen in Swiss Pat. No. 585 929 (rotational articulation) or U.S. Pat. No. 4,086,655 (sliding articulation). If the display mounted by itself in one of the parts of the watch is an analog display, only a small number of electrical connections will need to be provided between the movement and the display. For example, the analog display 3 of the watch in FIG. 2, which indicates only the hours and minutes, need only be connected to the integrated circuit of the movement by two electrical leads.

Figure 4:
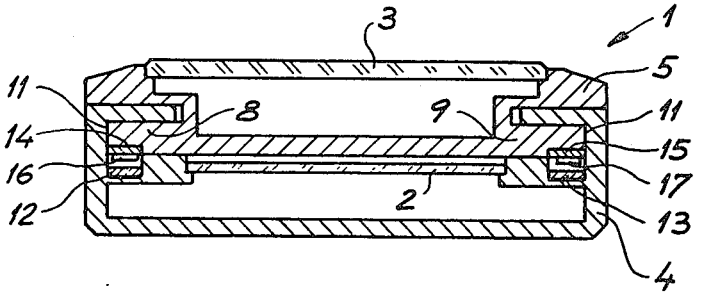
FIGS. 4 and 5 schematically illustrate the cases along section lines IV—IV and V—V of the watches in FIGS. 2*a* and 3*b*, respectively.

FIG. 4 shows, by way of example, a section of the case of the watch in FIG. 2*a*, in which the components of the movement and the display are not illustrated. The part 4 of the case 1, which houses the electronic movement of the watch, has two guides or slides 11 in which corresponding projecting portions 8 and 9 of the part 5 of the case carrying the second display means are engaged. In each guide 11, a spring blade 16, 17 ensures constant electrical contact between the conductive zones 12, 13 of the part 4 and the corresponding zones 14, 15 which face them on the part 5. All the conductive zones 12 to 15 are electrically insulated from the other portions of the case, and the zones of the part 4 are each connected to one of the outputs of the integrated circuit of the movement, while those of the part 5 are each connected to one of the terminals of the analog-display motor.

Figure 5:
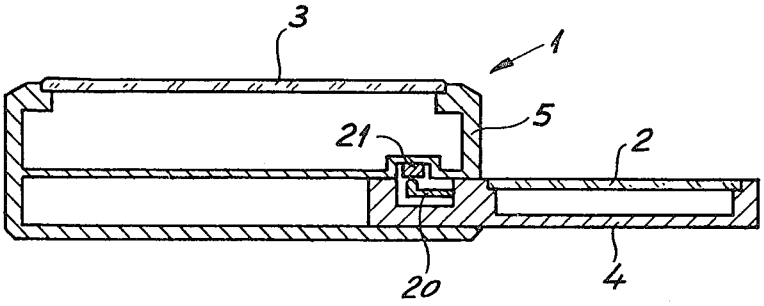

When the display mounted by itself in one of the parts of the case is of the digital type, as in FIG. 3, a greater number of connections are necessary between this display and the movement. In this case, as can be seen in FIG. 5, a series of elastic contacts 20 are provided which are integral with the part 4 which encloses the digital display and are connected to the appropriate inputs of the display cell. These contacts, in the second position of the parts of the case, press against conductive buttons 21 supported by the part 5 and are electrically connected to the movement mounted in the said part.

In the latter case, it will be seen that the display is fed by the movement only when the parts of the case are in their second position. An analogous effect can be achieved for all the configurations of the watch in accordance with the invention, by means of a suitable device reacting to the relative position of the parts of the case so as to disconnect the first display means in the first position of the said parts, when it is hidden by the second means, and to supply it normally in the second position.

Although this invention has been illustrated by certain embodiments, it is not so limited.

Thus, watches in accordance with the teachings of this invention can be provided shapes other than the substantially rectangular shape illustrated, particularly when the corresponding case has two parts that articulate by means of a hinge. In the same way, it would also be possible, within the teachings of the invention, to make watches having more than two display means, with one of the parts, articulating with the other in a rotational arrangement, being capable of housing, for example, a display means on each of its faces.

We claim:

1. A watch comprising at least one electronic movement and a first and a second display means for displaying time information mounted in a case, characterized in that the said case comprises an upper part and a separate lower part, said lower part comprising said first display means, said upper part comprising said second display means, said first display means comprising a digital time display and said second display means comprising an analog time display, said upper part normally covering said lower part enabling only said analog time display means to be visible, means connecting said upper and lower separate parts to move said upper part away from said lower part to permit said digital time display means to be visible, said upper part returned to cover said lower part during normal wear such that said analog time display is visible during normal wear.

2. A watch in accordance with claim 1, wherein said first and second display means are simultaneously visible when said parts are in said second position.

3. A watch in accordance with claims 1 or 2, wherein the parts of the case are mounted to be slideable with respect to one another.

4. A watch in accordance with claims 1 or 2, wherein said upper part is articulated rotationally on the lower part.

5. A watch in accordance with claim 1, wherein said first and second display means are both driven by said electronic movement, said movement being mounted in a part of the case that houses one of the first and second display means and being electrically connected to the other of said display means.

6. A watch in accordance with claim 5, wherein the parts of the case are movable with respect to each other by means of two slides, said electrical connection of the movement to the other of said display means being connected through said slides.

7. A watch in accordance with claim 1, wherein said first and second display means are each driven by a respective movement, with each respective movement being mounted in the respective part of the case which houses the corresponding display means.

8. A watch in accordance with claim 3, wherein said first and second display means are each driven by a respective movement, with each respective movement being mounted in the respective part of the case which houses the corresponding display means.

9. A watch in accordance with claim 4, wherein said first and second display means are each driven by a respective movement, with each respective movement being mounted in the respective part of the case which houses the corresponding display means.

10. A watch in accordance with claim 7, wherein the two parts of the case are separable from each other.

11. A watch according to claim 1, further comprising means for supplying power to said first display means in the second position, said power being cut off from supplying said first display means when said first display means is in said first position and blocked from view.

12. A watch in accordance with claim 2 wherein one of the parts of the case is articulated rotationally on the other.

13. A watch in accordance with claim 2 wherein said first and second display means are both driven by said electronic movement, said movement being mounted in a part of the case that houses one of the first and second display means and being electrically connected to the other of said display means.

14. A watch in accordance with claim 2 wherein said first and second display means are each driven by respective movement, with each respective movement being mounted in the respective part of the case which houses the corresponding display means.

15. A watch in accordance with claim 2 wherein the first display means is digital and the second display means is analog.

16. A watch according to claim 2 further comprising means for supplying power to said first display means in the second positon, said power being cut off from supplying said first display means when said first display means is in said first position and blocked from view.

* * * * *